United States Patent [19]

Kinser

[11] 3,990,734

[45] Nov. 9, 1976

[54] AUTOMATIC AUTOMOTIVE DOOR LOCK

[76] Inventor: Robert E. Kinser, 4050 46th Ave. S., St. Petersburg, Fla. 33711

[22] Filed: July 31, 1975

[21] Appl. No.: 600,934

[52] U.S. Cl. ..... 292/336.3
[51] Int. Cl.[2] ..... E05C 3/26
[58] Field of Search ..... 292/216, 280:DIG. 31, 292/DIG. 26, 336.3

[56] References Cited

UNITED STATES PATENTS

| | | | |
|---|---|---|---|
| 625,304 | 5/1899 | Kendrick | 292/288 |
| 2,534,693 | 12/1950 | Adams | 292/DIG. 31 |
| 3,697,105 | 10/1972 | Marx | 292/DIG. 26 |

*Primary Examiner*—Richard E. Moore
*Attorney, Agent, or Firm*—Theodore D. Lindgren

[57] ABSTRACT

A locking mechanism, and opening mechanism, particularly of the type used on doors of automotive vehicles, which comprises an actuating rod attached to an opening lever as well as to a key cylinder and activated by use of a key employed to turn said cylinder.

1 Claim, 3 Drawing Figures

AUTOMATIC AUTOMOTIVE DOOR LOCK

BACKGROUND OF THE INVENTION

1. Field of the Invention

The present invention relates to improvements in locks, more particularly to automotive-door locks. Still more particularly the invention relates to improvements in automotive-door locks which employ a combination of lock elements, at least one of which is movable, to automatically accomplish such locking.

2. Brief Description of the Prior Art

Present construction embodies a combination of a door button release, a key cylinder and an inside push button lock to perform a locking action for the purpose of securing a vehicle and/or its contents against theft. One type of known construction requires use of the key cylinder to lock the door of the vehicle when the operator leaves said vehicle unattended. Other types of known construction permit locking by means of either the push button or the key when the operator leaves the vehicle unattended.

A disadvantage of these types of known construction is that locking is not automatic and that often the vehicle is left unlocked because the lock must be actuated by a key or, in certain instances, by means of the inside push button. The extra effort required by the vehicle operator to perform these simple tasks is often too burdensome and, as a result, millions of dollars worth of vehicles and goods stored in vehicles are stolen each year.

SUMMARY OF THE INVENTION

It is an object of this invention to provide a novel means for automatically locking the doors on automotive vehicles.

Another object of this invention is to eliminate the draw-backs of presently known vehicle locks by making such locking action automatic.

The improved lock comprises a plurality of opening levers, an improved actuating rod attached to the key cylinder assembly, a door button assembly, an inside opening handle assembly and an inside push button lock.

The novel features which are considered as characteristic of the invention are set forth in particular in the appended claims. The improved lock itself, however, both as to its construction and its method of operation, together with additional features and advantages thereof, will be best understood from the following description of specific embodiments when read in conjunction with the accompanying drawings.

DESCRIPTION OF THE PREFERRED EMBODIMENT

Figure 1:
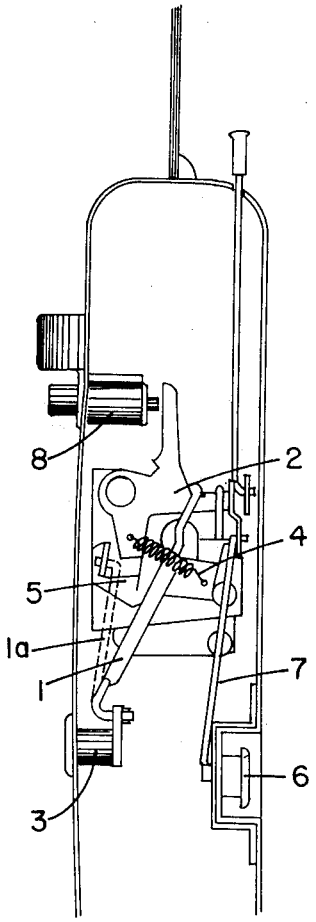
FIG. 1 is a schematic sectional view of a preferred embodiment of the present invention.

Referring to FIG. 1, there is shown an improved actuating rod 1 which replaces prior art actuating rod 1*a* and which is attached at its upper end to the upper opening lever 2, and at its lower end to the key cylinder 3. By inserting and turning a key in the key cylinder 3, the improved actuating rod is pulled downward, which in turn forces the inside arm of the upper opening lever 2, downward, thus disengaging it from the lower opening lever 5, and allowing the door of the vehicle to open.

Spring 4 is attached at one end to the upper opening lever 2 and at the other to the lower opening lever 5, and functions to keep these levers engaged at all times unless forced open by the improved actuating rod 1 or inside opening handle 6.

The inside opening handle 6 is attached by means of handle linkage 7 to the inside arm of the upper opening lever 2, allowing the action of the inside opening handle 6 to force the upper opening lever 2 downward, disengaging it from the lower opening lever 5 and thus opening the lock.

Figure 2:
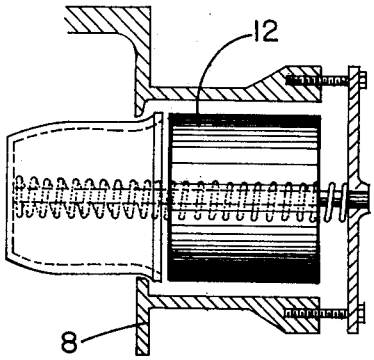
FIG. 2 is a cross-sectional view of the door button assembly.

Referring to FIG. 2 there is shown a spacer 12 which is inserted inside the door button assembly 8. This spacer 12 serves to make the door button assembly 8 located adjacent to the upper arm of upper opening lever 2 inoperative and assures that control of the vehicle lock is either from the inside or otherwise from the key cylinder 3 on the outside. This spacer 12 may be made of any appropriate material, such as metal, or plastic.

Figure 3:
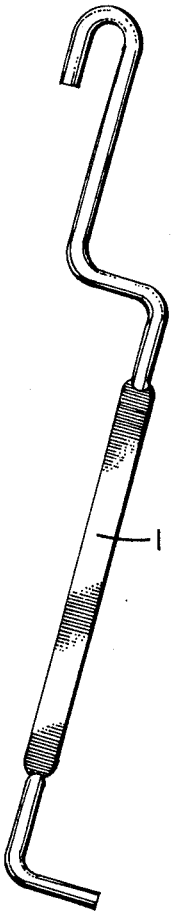
FIG. 3 is a plan view of the improved actuating rod.

FIG. 3 shows the design of the preferred embodiment of the improved actuating rod 1 that is necessary to allow its attachment to both the key cylinder 3 and the upper opening lever 2. The improved actuating rod 1 may be comprised of several linked members or may be formed integrally from any appropriate material, such as metal.

The present invention serves to provide a number of advantages over the prior art in that it alleviates the necessity of remembering to lock the vehicle each time before leaving it, thus discouraging theft/of or from unattended vehicles.

While the invention has been described in connection with different embodiments thereof, it is understood that it is capable of further modification, and this specification is intended to cover any variations of the invention as come within known or customary practice in the art to which the invention pertains.

What I claim is:

1. An automotive door lock comprised of an improved actuating rod attached at one end to the inside arm of an upper opening lever and attached at its other end to a key cylinder, a spring attached at one end to said upper opening lever and attached at its other end to a lower opening lever, a handle linkage attached at one end to said inside arm of said upper opening lever and attached at its other end to an inside opening handle, and an inoperative door button assembly adjacent to the upper arm of said upper opening lever.

* * * * *